US005223347A

United States Patent [19]

Lhymn et al.

[11] Patent Number: 5,223,347

[45] Date of Patent: Jun. 29, 1993

[54] CREEP RESISTANT COMPOSITE ALLOYS

[75] Inventors: Chang Lhymn; Yoon O. Lhymn, both of Erie, Pa.

[73] Assignee: Composites Technology International, Inc., Erie, Pa.

[21] Appl. No.: 736,510

[22] Filed: Jul. 26, 1991

Related U.S. Application Data

[63] Continuation-in-part of Ser. No. 314,950, Feb. 23, 1989, abandoned.

[51] Int. Cl.[5] ..... B32B 15/16

[52] U.S. Cl. ..... 428/614; 428/642; 428/643; 428/645; 428/646; 428/653

[58] Field of Search ..... 428/614, 642, 643, 645, 428/646, 650, 653

[56] References Cited

U.S. PATENT DOCUMENTS

| | | | |
|---|---|---|---|
| 3,163,500 | 12/1964 | Konrad et al. | 428/614 |
| 4,597,792 | 7/1986 | Webster | 428/614 |
| 4,663,242 | 5/1987 | Pryor et al. | 428/614 |
| 4,906,531 | 3/1990 | Ohmura et al. | 428/614 |
| 5,034,283 | 7/1991 | Lhymn et al. | 428/614 |

FOREIGN PATENT DOCUMENTS

| | | | |
|---|---|---|---|
| 62-33730 | 2/1987 | Japan | 428/614 |
| 310764 | 10/1971 | U.S.S.R. . | |

OTHER PUBLICATIONS

Blain, J. et al., "Ceramic and Metal Matrix Composites," Industrial Materials Research Institute, Canada, pp. 464–473, 1989.

*Primary Examiner*—George Wyszomierski
*Attorney, Agent, or Firm*—Ralph Hammar

[57] ABSTRACT

A fabrication method of strengthening metallic alloys by composite technology has been developed by mixing steel shots or aggregates with conventional alloys, thus preventing cold flow or creep. Preventing creep is advantageous in thermal plugs which must withstand fluid pressure without leakage until subjected to dangerous temperatures such as caused by fire. The matrix alloy primarily consists of some or all of copper, magnesium, bismuth, tin, lead, cadmium, and indium and the particle material is preferably iron or steel. New alloys exhibit a higher strength against a hydrostatic gas pressure than that of conventional matrix phase containing no reinforcing particles, while maintaining the melting temperature of new alloys in the same range of conventional unreinforced matrix alloy. The mixing of steel particles with the matrix is achieved by employing a flux such as ammonium chloride. Other reinforcible matrix alloys include tin-based, lead-based, copper-based, zinc-based, cadmium-based, indium-based, bismuth-based, magnesium-based, and aluminum-based alloys used for dynamic and structural parts requiring strength and creep resistance. Ferroaluminum shots are comprised primarily of iron and aluminum and they are light, relatively nonreactive with zinc, and bondable to aforementioned matrix alloys by using inorganic acid-based fluxes of zinc chloride, ammonium chloride, a mixture of chlorides, or a mixture of chlorides and fluorides. Other fluxes such as organic acid-based chemicals work as a cleaning agent when they can clean surface oxides of both the matrix alloy and reinforcing shots. Materials for alternative reinforcement include conventional steel or iron shots coated with sodium nitrite, ferroaluminum shots coated with sodium nitrite, nickel, copper, their base alloys refractory metals, copper or nickel-coated metals, copper or nickel-coated plastics, and copper or nickel-coated ceramics.

20 Claims, 1 Drawing Sheet

CREEP RESISTANT COMPOSITE ALLOYS

BACKGROUND OF THE INVENTION

This application is a continuation-in-part of application Ser. No. 07/314,950, filed Feb. 23, 1989, now abandoned, incorporated by reference.

Thermal plugs used in gas cylinders, cylinder valves, or pressure vessels contain a fusible alloy element as a safety device. In such applications, a thermal plug of said alloy is used to protect a metallic cylinder from rupture if the cylinder is accidentally exposed to high temperatures. The fusible alloy in such devices is exposed to a high pressure but not at elevated temperature and must have zero leakage. Quite often the fusible metal extrudes out of the plug at room temperature (cold flow), finally blows out and dumps the gas within the cylinder or a pressure vessel, an unwanted operation.

What is required is a new fusible alloy that withstands the high hydrostatic pressure without any extrusional deformation (cold flow) while the melting point is not increased. It must also exhibit zero leakage against a high pressure gas. Conceptually the composite technology has a potential of achieving such goals. However, there has been no success in finding a bondable reinforcement to the fusible alloy matrix. The present invention discloses how to wet the alloy matrix with reinforcing metal particles in such a way that the resulting new alloy can withstand the cold flow as a thermal plug for cylinders, cylinder valves, and pressure vessels.

The irregular geometry of particles or fibers with sharp edges, corners, and protrusions induces poor melt-flowability by the mechanism of interlocking and agglomeration. In other words, they are not die-castable and thus parts with a smooth surface finish without defects cannot be produced, for example, when the content of particles is greater than about 5% by volume. The breakthrough for this problem has been achieved by the present invention, i.e., shot-reinforced fusible, tin-based, lead-based, or zinc-based alloys. Shots are different from particles or fibers owing to their spherical shape and they intrinsically flow very well up to about 45% by volume, producing a very smooth surface without voids in die casting. Therefore, the mass production of die cast parts which are strong and creep-resistant has become possible with shot-reinforced alloys.

Shots, in short, serve the following purposes.

(1) Strengthening (2) Flowability (3) Die-castability

Fibers or particles serve only the strengthening purpose with no flowability. In lost core technology, for instance, the inside surface of intake manifolds must be smooth for the increase of engine efficiency. When the plastic is molded around the fusible core and subsequent decoring is done, the inside surface of the plastic manifold is smooth only when the cast core surface is smooth. Such smooth core having a desirable strength can be made only with shot-reinforced alloys.

As a practical example, fusible alloys used in a fire sprinkler system have a problem of cold flow under a stress due to the weak strength of fusible alloys. In a prior art described in U.S. Pat. No. 3,605,902, the reinforcement with random length loose fibers has been suggested for strengthening fusible alloys. This idea, however, has not been successfully reduced to practice because of the difficulty of economically forming a intermetallic bonding between fibers and matrix alloy.

In the preceding two examples, the bonding between steel shots and matrix alloys was accomplished by using a flux of ammonium chloride. Previously an inert or reducing atmosphere was employed to induce bonding between the alloy matrix and fibers coated with bondable metals such as copper. In the air atmosphere such intermetallic bonding is not achieved due to the oxidation problem. The use of flux enables the bonding to be achieved in air without the presence of bondable coating layer. Another uniqueness of the fluxing method is that the flux is applied to the molten liquid metal, not to the solid metal as has been done in the past. The appropriate flux must clean surface oxides of both the liquid alloy and reinforcing shots, thereafter forming an instantaneous intermetallic bonding between the molten alloy and shots. The uniqueness of flux in the present invention is thus as follows:

(1) Surface oxides of both the molten alloy and steel shots are cleaned by the flux in an air atmosphere.

(2) The fluidity of the molten liquid-state alloy covered with a liquid flux layer provides the high mobility required to wet the large number of shots in a very short time period.

(3) Immediately after surface oxides are removed, instantaneous intermetallic bonding is achieved between shots and liuqid alloy.

(4) The presence of a protective flux layer on the molten alloy surface negates the requirement of an inert or reducing atmosphere for mixing. The air environment is just enough mixing with the aid of a flux.

Generally, there are various kinds of fluxes: inorganic acid fluxes, organic acid fluxes, and liquid rosin fluxes. In the present invention, alternative acid fluxes will be introduced to induce the wetting and ferroaluminum shots which are comprised primarily of iron and aluminum will be employed as reinforcement.

The advantages of ferroaluminum shots over conventional steel shots are as follows. For certain applications such as lost core plastic molding, it is desirable to reduce the weight of steel shots for ease of handling and for reduction of energy consumption. The handling problem becomes serious particularly when the part made of fusible alloy is large. Such heavy product is handled by a robot and very often, the clamping pressure of a robotic arm induces indentation marks on the hot cast product surface, rendering the cast surface damanged. In another example involving zinc-based alloys, the reactivity of zinc with steel is very high to form a solid cake and thus the suppression of such reactivity is required to maintain the good melt-flow property. The preceding problems can be solved by ferroaluminum shots since iron-aluminum alloy shots are lighter than steel shots and the reactivity is decreased by the presence of aluminum in shots.

The problem of reactivity of zinc with steel or iron can be overcome by satisfying the following two conditions. Firstly, the aluminum content in the zinc alloy must be high enough to reduce the reaction rate between zinc and iron. Secondly, and more importantly, the temperature of the molten zinc alloy must be low enough to suppress the reaction between zinc and iron. Both conditions are met by ferroaluminum shots when the molten bath temperature is lower than about 850 degree F. Alternatively, conventional steel shots can be mixed with zinc and then aluminum is added quickly to stop the reaction ("melt-freeze" method) or steelshots are mixed directly with zinc-aluminum alloy using an acid flux comprised of chlorides and fluorides ("fluxing" method). Generally the fluxing and "ferroaluminum" method are more compatible with the conventional die casting process than the melt-freeze method.

The kinds of metal matrix reinforcible with ferroaluminum shots include not only zinc-based alloys but also tin-based, lead-based, bismuth-based, copper-based, and aluminum-based alloys. They can be used as gears, bearings, seals, bushings, rollers, cams, guides, brackets, axle housings, fasteners, knobs, inserts, housings, fusible links for fire sprinklers, thermal plugs for valves or cylinders, cores for lost core plastic molding, for work holding and work supporting, for accurate mold cold work, for setting punches in press tools, for tube bending, in die forming and jewellery manufacture, for proof casting and lens blocking, for protective blocks for radiography, and any static and dynamic parts requiring strength and creep resistance using aforementioned alloys. The strength of such alloys reinforced with shots is increased to help resist the creep or cold flow tendency and the flowability is provided by spherical shots.

SUMMARY OF THE INVENTION

In the present invention new alloys are described in which conventional metallic alloys are mixed with metal shots or aggregates to increase the mechanical strength while maintaining the surface characteristics same as conventional alloys. All the shots or aggregates remain in the core region and the surface skin region contains only the monolithic alloy phase, thus maintaining the good tribological properties on the surface while increasing the overall mechanical strength of the product. The mixing of steel shots or aggregates with the alloys is done by using a special flux of ammonium chloride as a cleaning agent. The final product fabricated by the die casting technique is characterized by a strong central part with well-supported wear-resistant thin surface layer.

The matrix phase of new fusible alloys is comprised of some or all of bismuth, tin, lead, cadmium, and indium metals. Their melting points are less than about 700 degree F. and in some cases they contain other elements such as antimony or silver. As a reinforcement, any wetted particles or spherical round or rounded geometry are used. Although any strong materials that are bondable to the matrix can be used as a reinforcement, the density of particles is desired to be close to that of the matrix phase in order to achieve a uniform dispersion of particles. In this invention, spherical steel shots are employed and the wetting of shot particles to be matrix alloy becomes possible by using a flux of ammonium chloride. Particles with any wetted coating can be mixed with any alloy matrix phases used for thermal plugs.

Zinc-based, tin-based, bismuth-based, lead-based, copper-based, aluminum-based, and any low-melting fusible alloys used for structural and dynamic parts are wetted by ferroaluminum shots using inorganic acid fluxes such as zinc chloride, ammonium chloride, a mixture of chloride, or a mixture of chlorides and fluorides. Other organic acid fluxes containing ammonium fluobo-rate work when they clean surface oxides of both matrix alloys and shots. All the aforementioned alloys are wetted effectively by steel or iron shots coated with sodium nitrite by using a chloride based flux. Other shots wettable with the preceding alloys by using an acid-based flux include stainless steel, copper, nickel, their base alloys, refractory metals, copper or nickel-coated steel, any copper or nickel-coated ceramics, any nickel or copper-coated plastics, any copper or nickel-coated metals, and any strong materials coated with bondable metallic layers such as those listed above.

As reinforcement for zinc alloys, the content of aluminum in ferroaluminum must be greater than a minimum in order to decrease the reaction rate between iron and zinc to a negligible level.

The shot-reinforced alloys are than die-castable with the surface smoothness comparable with the conventional unreinforced alloys while improving the creep or cold flow behavior.

Brass die casting alloys are also reinforcible with shots to improve the creep behavior. Magnesium-based alloys require a special flux under a nonoxidizing atmosphere for shots to be mixed.

The structure of an object according to the present invention is best seen in FIG. 1 and as shown in this figure the object includes a plurality of shots 1 or aggregates 2 dispersed in a desired alloy matrix material 3, e.g., conventional metallic alloy. In a product the reinforcement is comprised of shots only, aggregates only, or mixture of both.

The size of particles must be greater than a minimum in order to achieve a good melt flow and round particles are desired to enhance the melt flow property. The content of particles must be greater than a minimum, e.g., greater than 10% to obtain a high strength but less than a maximum, e.g., less than 50% to maintain a good melt flow behavior. Particles are also required to have a matrix-matching density for a uniform dispersion. Particles must be bondable to the matrix by employing a flux or by the presence of surface coating on particles as a coupling agent. As reinforcement, particles of one kind or different kinds can be employed, i.e., monolithic or hybrid composite alloy can be used. A preferred embodiment of reinforcing particles is iron or steel shots which can be mixed with the matrix alloy by employing a special flux such as ammonium chloride.

Iron-aluminum shots are fabricated by injecting a high pressure water jet to the molten iron-aluminum alloy stream and quenching into a water tank. Shots contain other miscellaneous impurity elements such as carbon, manganese, silicon, sulfur, and phosphorous. Shots are coated with sodium nitrite to prevent them from environmental corrosion and also to help assist the bonding reaction. The molten iron-aluminum bath is prepared by adding aluminum or ferroaluminum to the steel bath and the size of shots is controlled by adjusting various parameters such as shooting angle, melt temperature, water jet pressure, diameter of water jet, size of molten alloy stream, etc.

Ferroaluminum shots become bondable to the tin-based, bismuth-based, lead-based, copper-based, zinc-based, and aluminum-based alloys by adding cleaning chemicals of zinc chloride, ammonium chloride, a mixture of zinc chloride and ammonium chloride, and a mixture of chlorides and fluorides. For aluminum-based alloys and zinc-based alloys containing aluminum, a mixture of zinc chloride, ammonium chloride, and sodium fluoride is used as a flux. Reinforcible alloys are not limited to the aforementioned alloys but to any alloys whose melting point in lower than that of iron-aluminum alloy shot and wettable by the alloy shots by means of appropriate cleaning agent for flux. For example, magnesium-based alloys containing aluminum can be reinforced with ferroaluminum shots using a mixture of chlorides and fluorides as a flux under a protective atmosphere. In principle, an appropriate cleaning agent must clean (or remove surface oxides of) both the alloy shot and matrix alloy in order to induce the intermetallic bonding between them. Chloride-based acid fluxes are such cleaning agents as exemplified in ammonium chloride, zinc chloride, etc. Other inorganic acid or organic acid fluxes can work when they clean surface oxides of both the matrix alloy and ferroaluminum shots. Organic acids contain ammonium fluoborate as an ingredient.

The spherical shot geometry is the best shape in terms of good melt-flow property and surface smoothness of a die cast product. Other shapes such as particles, aggregates, or short fibers may be applicable as reinforcement, but they easily produce voids, cracks, rough surfaces, restricted flow in thin sections, and blocking of gates owing to the poor melt-flowability. Hybrid composites in which various kinds of reinforcement are incorporated simultaneously utilize some or all of shots, particles, aggregates, or short fibers as reinforcing agents. It is possible to maintain the melt-flowability when the reinforcing agents consist of mostly shots and a very small amount of particles or/and fibers.

As the strength increases with the increase of shot amount, the amount of shots must be greater than a minimum for a desirable strength improvement. However, as the content of shots rises, the melt-flow behavior starts to deteriorate and hence the amount of shots must be less than a maximum of 45% to maintain the good melt-flow property. The precise magnitude of such minimum and maximum depends on the shot size, kinds of matrix phase, kinds of shot material, and other process parameters.

The size of shots is determined by two factors: geometrical complexity of a desired product and strength requirement. The more complex the shape geometry, the finer the shot size and the finer the shot diameter, the stronger the mechanical strength. However, as the shot size decreases, the flow behavior tends to deteriorate and thus the maximum mixable content of shots tends to decrease. Consequently, there is an optimum condition in terms of shot amount, shot size, strength requirement, and flow behavior for a specific application. Generally, the diameter of shots ranges from about 0.004 to 0.2 inch and when the size of shot is much finer than the lower limit of 0.004 inch, the flow behavior deteriorates rapidly as in the case of powder reinforcement so that it is not die-castable.

Ferroaluminum shots are not the only kind of bondable reinforcement to the aforementioned matrix alloys but also conventional steel or iron shots coated with sodium nitrite and sodium nitrite-coated ferroaluminum shots are bondable to the matrix alloy. Other bondable reinforcements include stainless steel, copper, nickel, cobalt, their bare alloys, refractory metals, copper-coated steel, nickel-coated steel, copper or nickel-coated ceramics, copper or nickel-coated plastics, copper or nickel-coated metals, and any strong materials coated with bondable metallic layers comprised primarily of copper or nickel. They are insoluble in but wet by the preceding matrix alloys. The preceding reinforcements generally require the presence of a flux for bonding.

However, the bonding can take place without the presence of a cleaning flux when the mixing process is performed under a nonoxidizing (inert or reducing) environment and when reinforcing shots are coated with copper or nickel which are bondable to the matrix alloy. Conventional steel or iron shots are mixed with the aforementioned matrix alloys by using the flux of zinc chloride or a mixture of zinc chloride or ammonium chloride. All the preceding shots coated with sodium nitrite are also bondable to the aforementioned alloys by using the chloride-based fluxes. The function of sodium nitrite is twofold. It acts as a rust inhibitor and also acts with chloride to generate a mixture of nitric and hydrochloric acid so that the surface oxides can be rapidly removed.

The advantages of ferroaluminum shots are light weight, easy handling, energy saving, reduced reactivity with the matrix alloy (particularly with zinc), and improved resistance to the environmental corrosion.

For zinc alloys, the content of aluminum in ferroaluminum must be greater than a minimum to suppress the reaction between zinc and iron. When zinc chloride or ammonium chloride is used as a flux, the iron-25 wt.% aluminum alloy shot is mixable but the ferroaluminum shot containing 75 wt.% aluminum is not mixable and therefore, for high aluminum content shots, aluminum soldering fluxes consisting of chlorides and fluorides are required.

Tin-based alloys are comprised primarily of tin and some or all elements of lead, bismuth, antimony, cadmium, indium, and silver. Lead-based alloys are comprised primarily of lead and some or all elements of tin, bismuth, antimony, cadmium, indium, and silver. Bismuth-based alloys are comprised primarily of bismuth and some or all elements of tin, lead, antimony, cadmium, indium, and silver. They are wettable with ferroaluminum or sodium nitrite-coated iron or steel shots using chloride-based fluxes such as zinc chloride or ammonium chloride. For high aluminum content ferroaluminum shots, aluminum soldering flux is employed. Using aluminum fluxes, aluminum shots can be used as reinforcement for lost core molding cores.

Zinc-based alloys are comprised of a major element of zinc and a minor element of aluminum together with copper and magnesium and a trace amount of some or all elements of iron, lead, cadmium, tin, titanium, nickel, and chromium. They are mixable with sodium nitrite-coated iron or steel shots or ferroaluminum shots using acid fluxes consisting of ammonium chloride, zinc chloride, and sodium fluoride at temperatures lower than about 830 to 850 degree F. but higher than the melting points of zinc alloys and also the working temperature of fluxes. For example, the melting point of zinc plus 3.5–4.3 wt. % aluminum alloy ranges from 718 to 727 degree F.

Copper-based alloys are comprised primarily of copper and some or all elements of zinc, tin, lead, iron, aluminum, manganese, and silicon. Aluminum-based alloys are comprised primarily of aluminum and some or all elements of tin, silicon, iron, copper, and nickel. They are wetted with ferroaluminum or steel shots coated with sodium nitrite using chloride-based fluxes.

Magnesium-based alloys are comprised of a major element of magnesium and a minor element of aluminum togehter with a trace amount of zinc, silicon, manganese, and copper. Shots are mixed under an inert atmosphere using a special flux. Applications include wheels, transmission housings, crank cases, chain saws, lawn mower decks, tools, etc.

One example of organic acid-based flux is comprised of aminoethylethanolamine, ammonium fluoborate, and zinc oxide.

BRIEF DESCRIPTION OF THE DRAWING

The foregoing as well as other aspects of the present invention will become clear from the following detailed description when taken in conjunction with the appended figure in which.

DETAILED DESCRIPTION OF THE PREFERRED EMBODIMENTS

Figure 1:
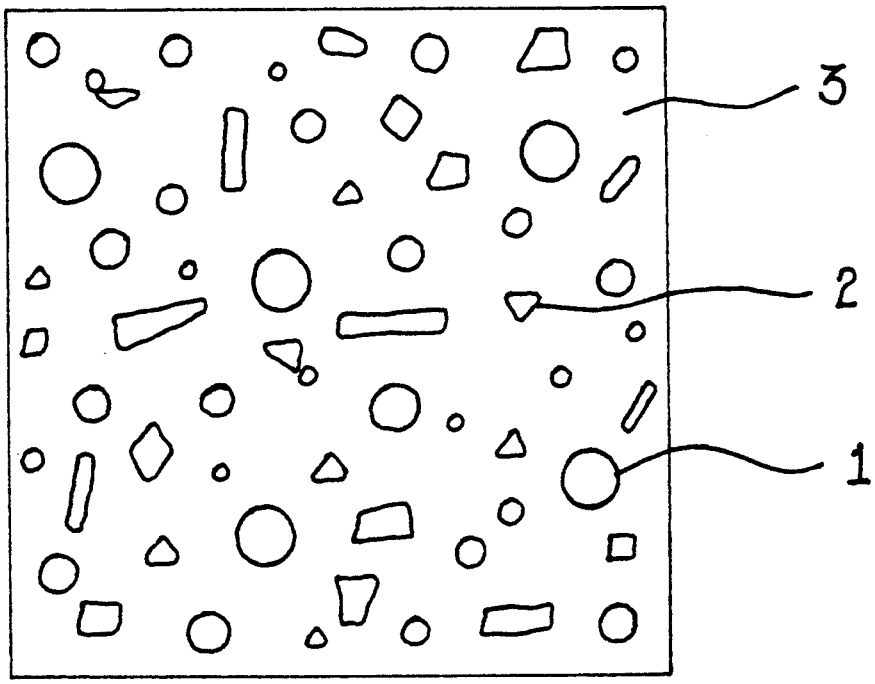
FIG. 1 shows a pictorial view of microstructure of new composite alloys comprised of shots 1, aggregates of nonspherical shape 2, and alloy matrix phase 3.

There are various kinds of metallic alloys used for bearings, bushes, washers, gears, or such load-bearing applications including structural parts as exemplified in white metal, copper-lead, aluminum-tin, and zinc-based alloys. In the present invention, the reinforcement of such monolithic alloys is done with shots or with aggregates of random geometry, the density of aggregates being preferably close to the matrix alloy for a uniform dispersion. Furthermore, steel shots or aggregates must be bondable to the matrix phase and this is achieved by melting the alloy and then adding the shots or aggregates together with ammonium chloride under continuous stirring at a temperature greater than the melting point of the matrix phase but less than the fusing temperature of steel shots or aggregates. The molten metallic alloy dispersed with shots or aggregates are then die-cast into a mold. The die-cast products are stronger than the unreinforced alloys and the surface finish is as smooth as conventional alloys. The amount of reinforcing shots or aggregates must be greater than a minimum, e.g., 5%, to enhance the mechanical strength appreciably and less than a maximum, e.g., 50%, to maintain a good melt flow behavior. The mode of reinforcement is either monolithic, i.e., shots only or aggregates only, or hybrid, i.e., mixture of shots and aggregates. The geometry of aggregates is either isotropic or anisotropic and aggregates often have a surface coating to improve the bondability to the matrix phase when an appropriate flux cannot be found.

Die-cast composite alloys do not exhibit cold flow behavior due to the high mechanical strength of core while preserving the good tribological behavior of monolithic alloys on the surface. Molten composite alloys are also spray-coated onto a substrate and the final parts are sometimes sintered using the powder metallurgical technique. Strengthened new composite alloys will be useful for dynamic and static structural parts and thus the size miniaturization in automation, applicance, and automobile industries has become possible.

EXAMPLE 1

Zinc Alloys

Zinc-aluminum alloys are mixed with steel or iron shots using an acid flux comprised of ammonium chloride, zinc chloride, and sodium chloride. The zinc alloys are also mixable with ferroaluminum shots using the same flux at about 800 degrees F.

The amount of shots is about 25 to 30 wt. % and the size of shots ranges from 0.004 to 0.1 inch in diameter. In order to maintain the melt temperature below about 850 degree F., the content of aluminum in zinc alloys is limited to below about 10 wt. %.

The kinds of zinc alloys mixable with shots are as follows:

(1) About 3.5–4.3 wt. % aluminum, about 0.25 wt. % copper, about 0.02–0.05 wt. % magnesium, and remainder zinc (number 3 alloy).

(2) About 3.5–4.3 wt. % aluminum, about 0.75–1.25 wt. % copper, about 0.03–0.08 wt. % magnesium, and remainder zinc (number 5 alloy).

(3) About 3.5–4.3 wt. % aluminum, about 0.25 wt. % copper, about 0.005–0.02 wt. % magnesium, about 0.005–0.02 wt. % L nickel, and remainder zinc (number 7 alloy).

(4) About 0.01–0.04 wt. % aluminum, about 1.0–1.5 wt. % copper, about 0.02 wt. % magnesium, about 0.15–0.25 wt. % titanium, about 0.1–0.2 wt. % chromium, and remainder zinc (number 16 alloy).

(5) About 8.0–8.8 wt. % aluminum, about 0.8–1.3 wt. % copper, about 0.03–0.015 wt. % magnesium, and remainder zinc (ZA 8).

(6) About 10.5–11.5 wt. % aluminum, about 0.5–1.25 wt. % copper, about 0.015–0.03 wt. % magnesium, and remainder zinc (ZA 12).

(7) The matrix alloy comprised of 73 wt. % zinc and 27 wt. % aluminum was prepared by melting and to this molten alloy steel shots were added using the ammonium chloride as a cleaning agent. The weight fraction of steel shots is less than about 50 wt. % and the size of steel shots is less than about 0.5 inch in diameter. The actual size of shot is about 0.5 mm in diameter. Other matrix alloys tried were 88 wt. % zinc and 12 wt. % aluminum, and 97.5 wt. % zinc and 2.5 wt. % aluminum. They are basically zinc-aluminum alloys.

EXAMPLE 2

Aluminum Alloys

The matrix alloy comprised of 80 wt. % aluminum and 20 wt. % tin was prepared by melting and to this molten alloy phase steel shots were added with ammonium chloride as a flux. The weight fraction of steel shots is less than about 50 wt. % and the size of shots is less than about 0.5 inch in diameter. The actual size of shot is about 0.020 in diameter.

Composites comprised of aluminum-based alloy matrix reinforced with ferroaluminum shots are fabricated by using a flux consisting of ammonium chloride, zinc chloride, and sodium fluoride, or by a mixture of zinc chloride and ammonium chloride. Sodium nitrite-coated steel shots are also bondable using the preceding fluxes. The content of shots is about 20 to 30 wt. % and the diameter of shots ranges from 0.004 to 0.1 inch. The composition of aluminum alloy is, for example, about 80 wt. % aluminum, and about 20 wt. % tin together with small additions of silicon, iron, copper, and nickel.

EXAMPLE 3

Copper Alloys

The matrix alloy comprised of 80 wt. % copper, 10 wt. % tin, and 10 wt. % lead was prepared by melting and to this molten alloy steel shots were added with ammonium chloride as a flux agent. The weight fraction of steel shots is less than about 50 wt. % and the size of steel shots is less than about 0.5 inch in diameter. The actual size of shot is about 0.020 in diameter.

Composites consisting of copper-based matrix alloy reinforced with ferroaluminum shots or sodium nitride-coated steel shots are fabricated using a flux of zinc chloride or a mixture of zinc chloride and ammonium chloride. The content of shots is about 20 to 30 wt. % of the composite alloy and the size of shots ranges from 0.004 to 0.1 inch in diameter.

One example of matrix compositions is about 58–63 wt. % copper, about 1.0 wt. % tin, about 0.5–2.5 wt. % lead, about 0.5 wt. % iron, about 0.2–0.8 wt. % aluminum, about 0.5 wt. % manganese, and about 0.5 wt. % silicon.

EXAMPLE 4

Lead Alloys

The matrix alloy comprised of 83 wt. % lead, 15 wt. % antimony, and 1 wt. % tin was prepared by melting and to this molten alloy steel shots were added with ammonium chloride as a flux. The weight fraction of steel shots is less than about 50 wt. % and the size of steel shots is less than about 0.5 inch in diameter. The actual size of shot is about 0.020 in diameter.

Composites comprised of lead-based alloy matrix reinforced with steel shots, sodium nitrite-coated steel or iron shots, or ferroaluminum shots are fabricated using a flux consisting of a mixture of zinc chloride and ammonium chloride. The content of shots is about 30 to 40 wt. % of the composite alloy and the diameter of shots ranges from 0.004 to 0.1 inch. One example of lead alloy is about 83 wt. % lead, about 15 wt. % antimony, and about 1 wt. % tin.

EXAMPLE 5

Tin Alloys

The matrix alloy comprised of 89 wt. % tin, 7.5 wt. % antimony, and 3.5 wt. % copper was prepared by melting and to this molten alloy steel shots were added with ammonium chloride as a flux. The weight fraction of steel shots is less than about 50 wt. % and the size of shots is less than about 0.5 inch in diameter. The actual size of shot is about 0.020 in diameter.

Composite alloys comprised of tin-based matrix alloy reinforced with ferroaluminum shots are fabricated by using a flux of zinc chloride. The content of shots is about 30 to 45 wt. % and the size of shots ranges from 0.004 to 0.1 inch in diameter. Some examples of the tin-based matrix phase are as follows:

(1) About 59 wt. % tin, about 38 wt. % lead, and about 3 wt. % antimony.

(2) About 90 wt. % tin and about 10 wt. % bismuth.

Sodium nitrite-coated steel shots are also mixed with tin alloys using ammonium chloride or zinc chloride with the shot content being about 30 to 45 wt. % of the composite alloy.

EXAMPLE 6

Bismuth Alloys

Composite alloys comprised of bismuth-based matrix alloy reinforced with ferroaluminum shots are fabricated using a flux of zinc chloride or a mixture of ammonium chloride and zinc chloride. The content of shots is about 30 to 45 wt. % of the composite alloy and the size of shots ranges from 0.004 to 0.1 inch in diameter. Sodium nitrite-coated steel shots are also mixed with bismuth alloys using chloride-based fluxes. Some examples of matrix compositions are as follows:

(1) About 54 wt. % bismuth, about 26 wt. % tin, and about 20 wt. % cadmium.

(2) About 50 wt. % bismuth, about 27.8 wt. % lead, about 12.4 wt. % tin, and about 9.3 wt. % cadmium.

(3) About 57 wt. % bismuth, about 17 wt. % tin, and about 26 wt. % indium.

(4) About 57 wt. % bismuth, and about 43 wt. % tin.

EXAMPLE 7

Magnesium Alloys

The matrix alloy is comprised of about 9.0–10.5 wt. % aluminum, about 0.3–1.0 wt. % zinc, about 0.3 wt. % silicon, about 0.15–0.4 wt. % manganese, about 0.15 wt. % copper, and remainder magnesium. Steel or ferroaluminum shots are mixed with the magnesium alloy under an inert nitrogen atmosphere using a flux consisting of chlorides and fluorides.

The compositions shown in the preceding seven examples represent the actual try and compositional details can be changed as long as handling permits, i.e., flowable after mixing. In other words, any compositional variations must satisfy the following requirements.

(1) Mixable (2) Flowable once mixed

As a reinforcement, any strong bondable aggregates or particles can replace steel shots to improve the creep resistance as long as they are mixable with and bondable to the composite once mixed with the matrix alloy phase.

From the requirement of flowability, shot and round and rounded geometry are an ideal reinforcing geometry while from the viewpoint of strength, fiber shape is preferred. However, the fiber geometry presents a flowability problem in the die casting process, producing defects in the cast product. The present technology of producing strong composite alloys can be applied to any size of load-bearing parts except for thin walls or shells. New alloys can be applied for both dynamic and static parts.

We claim:

1. A creep-resistant alloy composite for casting static and dynamic parts, said alloy being flowable in the molten state, said alloy consisting essentially of:

(a) first component of matrix alloy phase which is bondable to reinforcing shots, said matrix alloy being bismuth-based alloy; and (b) a second component of reinforcing shots bondable to said matrix alloy, said shots being flowable with said alloy when said alloy is in the molten state.

2. The alloy of claim 1 further containing a third element of nonspherical aggregates, the content of said aggregates being small enough not to degrade the melt-flowability and castability of said composite.

3. The alloy composite of claim 1 wherein said shots are selected from the group consisting of steel, iron, copper, nickel, cobalt, refractory metals, their base alloys, copper or nickel-coated ceramics, copper or nickel-coated plastics, copper or nickel-coated metals, and plastics, ceramics, or metals coated with bondable metallic layer other than copper or nickel.

4. An alloy composite for casting for static and dynamic parts, said alloy being flowable in the molten state, said alloy consisting essentially of:

(a) a first component matrix alloy phase selected from the group consisting of bismuth-based alloy, tin-based alloy, and lead-based alloy, and (b) a second component of reinforcing aggregates of nonspherical shape which are bondable to said matrix alloy, said aggregates being flowable with said alloy in its molten state, the content of said aggregates being larger than about 20 vol. %.

5. The alloy composite as claimed in claim 4 which has been prepared by mixing said first component with said second component by using a flux.

6. The alloy composite as claimed in claim 4 wherein said aggregates are made bondable to the matrix alloy by the presence of bondable metallic coating on said aggregates.

7. The alloy composite as claimed in claim 4 wherein said aggregates have been mixed with said matrix alloy without any flux.

8. The alloy composite of claim 4 comprised of the matrix alloy phase of claim 4 and a reinforcing phase, said reinforcing phase consisting of a major amount of nonspherical aggregates of claim 3 and a minor amount of spherical shots, the content of said reinforcing phase being greater than about 20 vol. %.

9. The alloy of claim 4, wherein said aggregates are selected from the group consisting of steel, iron, copper, nickel, cobalt, refractory metals, their base alloys, copper or nickel-coated ceramics, copper or nickel-coated plastics, copper or nickel-coated metals, and any strong plastics, ceramics, or metals coated with bondable metallic layer other than copper or nickel.

10. A composite alloy having a good melt-flowability and creep resistance, said composite alloy comprising a fusible matrix alloy and reinforcing rounded or spherical shots with reinforcing particles of nonspherical geometry, said matrix alloy including one or more of bismuth, tin, lead, cadmium, antimony, silver, and indium, said shots and reinforcing particles being mixed with and bonded to said matrix alloy, said shots and reinforcing particles flowing with the alloy when said alloy is in the molten state, the content of said shots and particles being greater than about 20 vol. %.

11. The alloy of claim 10 wherein said shots and reinforcing particles are selected from the group consisting of steel, iron, copper, nickel, cobalt, refractory metals, their base alloys, copper or nickel-coated ceramics, copper or nickel-coated plastics, copper or nickel-coated metals, and any strong plastics, ceramics, or metals coated with bondable metallic layer other than copper or nickel.

12. The alloy of claim 3, claim 11, or claim 9 wherein the particles, shots or aggregates are selected from the group consisting of iron and nickel of a size of larger than about 120 um.

13. A composite alloy comprised of matrix alloy phase of claim 10 and reinforcing agent, said reinforcing agent consisting of a major amount of spherical shots and a minor amount of nonspherical reinforcing phase, the content of said shots being greater than about 20 vol. %.

14. The composite alloy of claim 13, wherein said shots and nonspherical reinforcing phase are selected from the group consisting of steel, iron, copper, nickel, cobalt, refractory metals, their base alloys, copper or nickel-coated ceramics, copper or nickel-coated plastics, copper or nickel-coated metals, and any strong/insoluble plastics, or metals coated with bondable metallic layer other than copper or nickel.

15. The alloy of claim 14, wherein the shots or nonspherical phase are selected from the group consisting of iron and nickel of a size of greater than about 120 $\mu$m.

16. The alloy of claim 13 wherein said shots and reinforcing phase are made bondable to said matrix alloy by using a flux.

17. The alloy of claim 13, wherein said shots and reinforcing phase are made bondable to said matrix alloy without using a flux.

18. The alloy of claim 10, wherein said shots and particles are made bondable to said matrix alloy by the presence of bondable coating on said shots and particles.

19. The alloy of claim 10, wherein said shots and particles are made bondable to said matrix alloy by using a flux selected from the group consisting of:

(1) Inorganic acid fluxes, and (2) Organic acid-based fluxes.

20. The alloy of claim 10, wherein said shots and particles are made bondable to said matrix alloy without using a flux.

* * * * *